US009160065B2

(12) United States Patent
Lu et al.

(10) Patent No.: US 9,160,065 B2
(45) Date of Patent: Oct. 13, 2015

(54) SUBSTRATE EMBEDDED ANTENNA AND ANTENNA ARRAY CONSTITUTED THEREBY

(71) Applicant: National Taiwan University, Taipei (TW)

(72) Inventors: Hsin-Chia Lu, Taipei (TW); Che-Chun Kuo, Taipei (TW); Chen-Fang Tai, Hsinchu (TW)

(73) Assignee: NATIONAL TAIWAN UNIVERSITY, Taipei (TW)

( * ) Notice: Subject to any disclaimer, the term of this patent is extended or adjusted under 35 U.S.C. 154(b) by 183 days.

(21) Appl. No.: 13/788,444

(22) Filed: Mar. 7, 2013

(65) Prior Publication Data

US 2014/0028515 A1 Jan. 30, 2014

(30) Foreign Application Priority Data

Jul. 26, 2012 (TW) ..... 101126917 A

(51) Int. Cl.

| | |
|---|---|
| ***H01Q 1/36*** | (2006.01) |
| ***H01Q 9/16*** | (2006.01) |
| ***H01Q 21/00*** | (2006.01) |
| ***H01Q 19/10*** | (2006.01) |
| ***H01Q 1/24*** | (2006.01) |
| ***H01Q 1/40*** | (2006.01) |
| ***H01Q 1/52*** | (2006.01) |
| ***H01Q 21/29*** | (2006.01) |

(52) U.S. Cl.

CPC ..... *H01Q 1/36* (2013.01); *H01Q 1/243* (2013.01); *H01Q 1/40* (2013.01); *H01Q 1/523* (2013.01); *H01Q 9/16* (2013.01); *H01Q 19/10* (2013.01); *H01Q 21/00* (2013.01); *H01Q 21/293* (2013.01)

(58) Field of Classification Search

CPC ..... H01Q 1/36; H01Q 9/16; H01Q 21/00; H01Q 19/10

USPC ..... 343/700 MS, 834, 835, 893, 793

See application file for complete search history.

(56) References Cited

U.S. PATENT DOCUMENTS

| | | | | |
|---|---|---|---|---|
| 5,657,033 | A * | 8/1997 | Young | 343/786 |
| 6,064,350 | A * | 5/2000 | Uchimura et al. | 343/786 |
| 7,812,767 | B2 * | 10/2010 | Seki et al. | 343/700 MS |

OTHER PUBLICATIONS

Che-Chung Kuo, Hsin-Chia Lu, Po-An Lin, Chen-Fang Tai, Yue-Ming Hsin, Huei Wang; A Fully SiP Integrated V-Band Butler Matrix End-Fire Beam-Switching Transmitter Using Flip-Chip Assembled CMOS Chips on LTCC; Journal; May 2012; 13 pages; vol. 60, No. 5; IEEE Transactions on Microwave Theory and Techniques; U.S.A.

* cited by examiner

*Primary Examiner* — Hoanganh Le
(74) *Attorney, Agent, or Firm* — Bacon & Thomas, PLLC

(57) ABSTRACT

The present invention provides a substrate-embedded antenna and an antenna array constituted by said antennas. An antenna of the present invention comprises a plurality of substrates, a metal fill and a feed line. Each of the substrates has at least one through-hole. The metal fill is placed within each through-hole, and each metal fill placed therein connects one another to form a columnar metal conductor which acts as a radiating body of the antenna. The feed line is electrically coupled to the metal conductor to input and output electrical signals. A plurality of said antennas may constitute an antenna array.

12 Claims, 10 Drawing Sheets

SUBSTRATE EMBEDDED ANTENNA AND ANTENNA ARRAY CONSTITUTED THEREBY

BACKGROUND OF THE INVENTION

1. Field of the Invention

The present invention relates to an antenna, and more particularly, to a substrate-embedded antenna.

2. Description of the Prior Art

Using Internet to exchange information and communicate is very common in modern days, and recently, using radio communication systems to exchange different types of data, such as voice or text messages, media files, etc., has become one of the most popular ways of communication. As antennas receive and transmit radio waves, the need for smaller antennas providing high-speed communications is increasing when mobile devices become even more popular. Smaller antennas can be integrated into handheld systems or portable communications devices more favorably.

A conventional antenna used within a portable communications device is generally a patch antenna or dipole antenna printed on the surface of a multi-layer substrate. A patch antenna can provide broadside radiation which is perpendicular to the orientation of the substrate's surface. A dipole antenna can provide end-fire radiation which is either perpendicular or parallel to the substrate's surface. However, these two types of antenna both occupy much surface area of a substrate, and may thus have less surface area for a chip or other components to use.

SUMMARY OF THE INVENTION

In view of the above, the present invention aims to propose an antenna that improves the drawbacks of a conventional antenna. A substrate-embedded antenna is proposed that can increase the surface area of a substrate for chips or other components, provides end-fire radiation, and can be applied to short-range millimeter-wave communications in the field of high-speed wireless data communications.

According to the concept of the present invention, an antenna is provided which comprises: a plurality of substrates, each of the substrates having at least one through-hole; a metal fill placed within each of the plurality of through-holes, the metal fill within each through-hole connecting one another to form a columnar metal conductor which acts as a radiating body of the antenna, wherein the columnar metal conductor forms a U-shaped folded monopole antenna, or two columnar metal conductors form a reverse V-shaped antenna, or the columnar metal conductor forms an annular antenna, or the columnar metal conductor forms a dipole antenna; and a feed line electrically coupled to the radiating body to input and output electrical signals.

Based on the above concept, the antenna further comprises a metal reflector placed at a direction opposite to a desired radiation direction of the radiating body to concentrate its radiation in a desired direction.

Based on the above concept, the antenna further comprises a ground plane within the plurality of substrates, each ground plane having a ground contact.

Based on the above concept, the plurality of substrates are made of or constituted by one of the following: fiberglass substrates, plastic, ceramic, low temperature co-fired ceramics (LTCC) and printed circuit boards (PCB).

Based on the above concept, the metal fill can be selected from silver or copper.

Based on the above concept, the ground plane of the antenna is perpendicular to the radiating body.

Based on the above concept, the ground plane of the monopole antenna is parallel to the radiating body.

Based on the above concept, the length of the longer side of the monopole antenna is approximately ⅜ wavelength of the antenna's minimum operating frequency.

Based on the above concept, electromagnetic radiation of the monopole antenna has a frequency of 60 GHz.

According to another concept of the present invention, there is provided an antenna array which is constituted by a plurality of the foregoing antennas arranged side by side. Preferably, the antenna array comprises a metal reflector placed at a direction opposite to a desired radiation direction of the radiating body to concentrate its radiation in a desired direction. Preferably, the metal reflector contains at least one isolation spacing to avoid interference among the plurality of radiating bodies.

The present invention provides an antenna embedded within substrates, and therefore, the surface area in need is substantially reduced. Moreover, an antenna of the present invention can provide end-fire radiation, and can form an antenna array easily. Because of the above features, an antenna of the present invention is suitable for use with portable systems and suitable for short-range millimeter-wave communications in the field of high-speed wireless data communications.

These and other features, aspects, and advantages of the invention will be described in more detail below hereinafter with reference to the accompanying drawings, in which preferred embodiments of the invention are shown. It is to be understood that all kinds of alterations and changes can be made by those skilled in the art without deviating from the spirit and the scope of the invention. This description is not to be taken in a limiting sense, but is made merely for the purpose of illustrating the general principles of the invention.

DETAILED DESCRIPTION OF THE PREFERRED EMBODIMENTS

The present invention now will be described more fully hereinafter with reference to the accompanying drawings, in which preferred embodiments of the invention are shown.

First Embodiment

Figure 1:
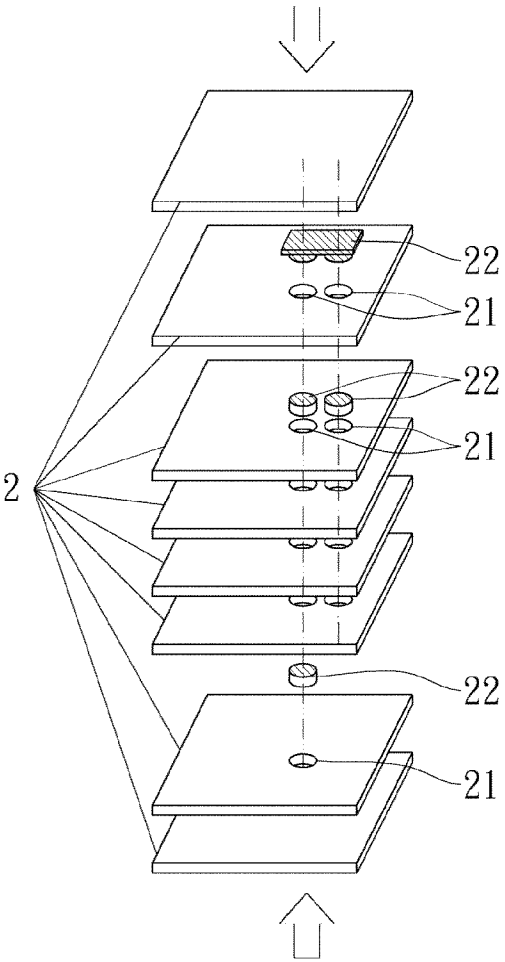
FIG. 1 is the exploded view of the stacked substrates.
Figure 2:
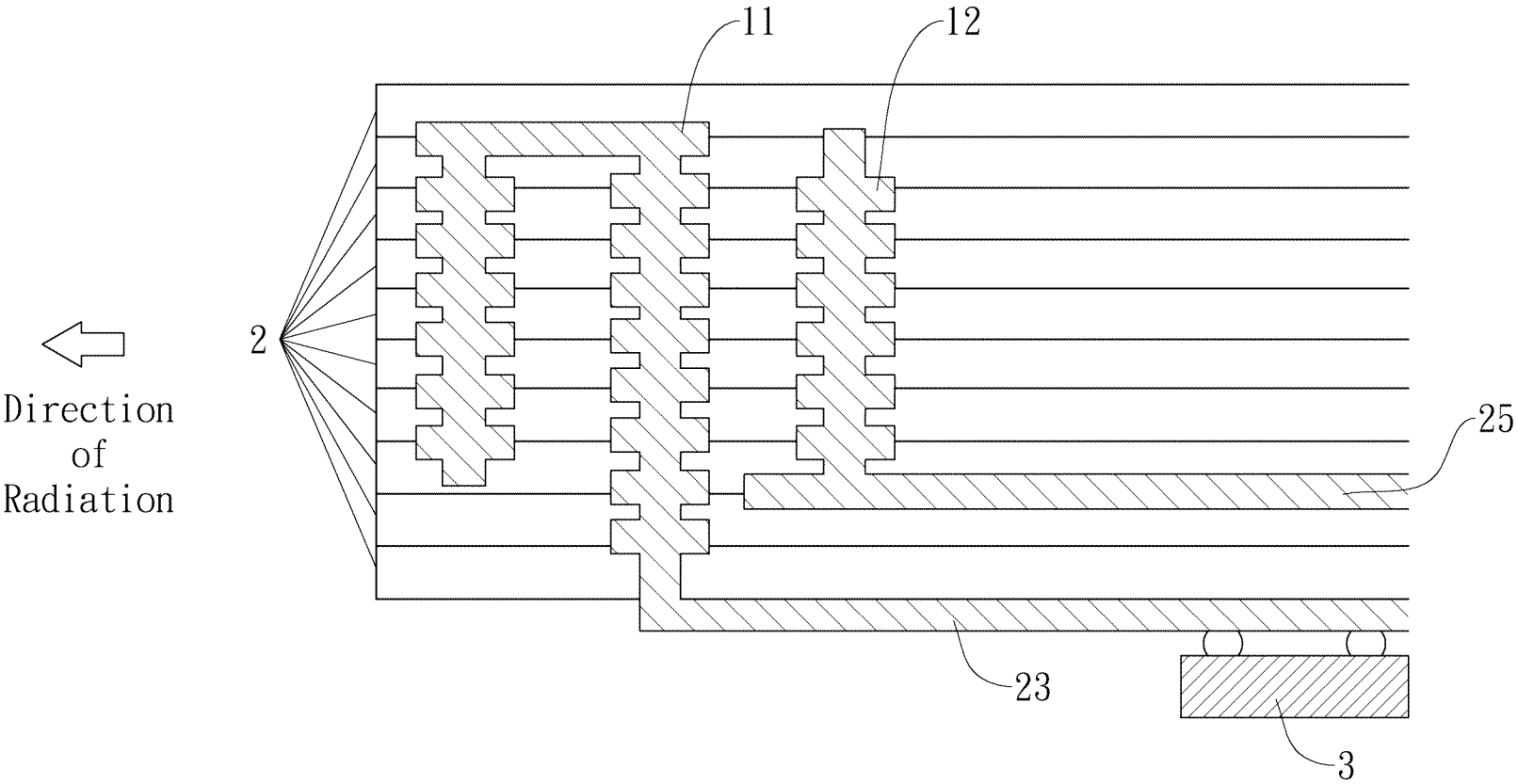
FIG. 2 shows a side cross section view of a monopole antenna according to a first embodiment of the present invention.

FIG. 1 is a schematic view showing the stacked substrates according to a first embodiment of the present invention. As FIG. 1 shows, each of the plurality of substrates 21 has one or more through-holes 21, while the plurality of through-holes 21 interconnect with one another vertically. A metal fill 22 is filled in each through-hole 21, and then the plurality of substrates 21 are stacked together so that the metal fills 22 form a columnar metal conductor (as shown in FIG. 2), which acts as a radiating body of the antenna. The through-holes 21 may have equal or unequal diameters at each layer. A typical material for the metal fill 22 is silver or copper. The plurality of substrates 2 can be made of or constituted by one of the following but not limited to: fiberglass substrates, plastic, ceramic, low temperature co-fired ceramics (LTCC) and printed circuit boards (PCB). When the substrate 2 is a printed circuit board, the through-hole 21 preferably has the metal fill 22 on its inner wall and air in the center.

FIG. 2 shows a side cross section view of the first embodiment. As FIG. 2 shows, the radiating body 11 in this embodiment has a folded reverse U-shape and forms a monopole antenna embedded in substrates. To assure a proper impedance matching to about 50 ohms, the length of the longer side of the radiating body is approximately ⅜ wavelength of the antenna's minimum operating frequency but is not limited thereto. Preferably, a metal reflector 12 is placed at a direction opposite to a desired radiation direction of the radiating body to concentrate its radiation in a desired direction. The antenna of the present invention comprises a feed line 23 electrically coupled to the radiating body 11 for inputting and outputting electrical signals. In this embodiment, one end of the feed line 23 is connected to a CMOS amplifier 3. The antenna further comprises a ground plane 25 within the plurality of substrates 2, and the ground plane has a ground contact.

Figure 3:
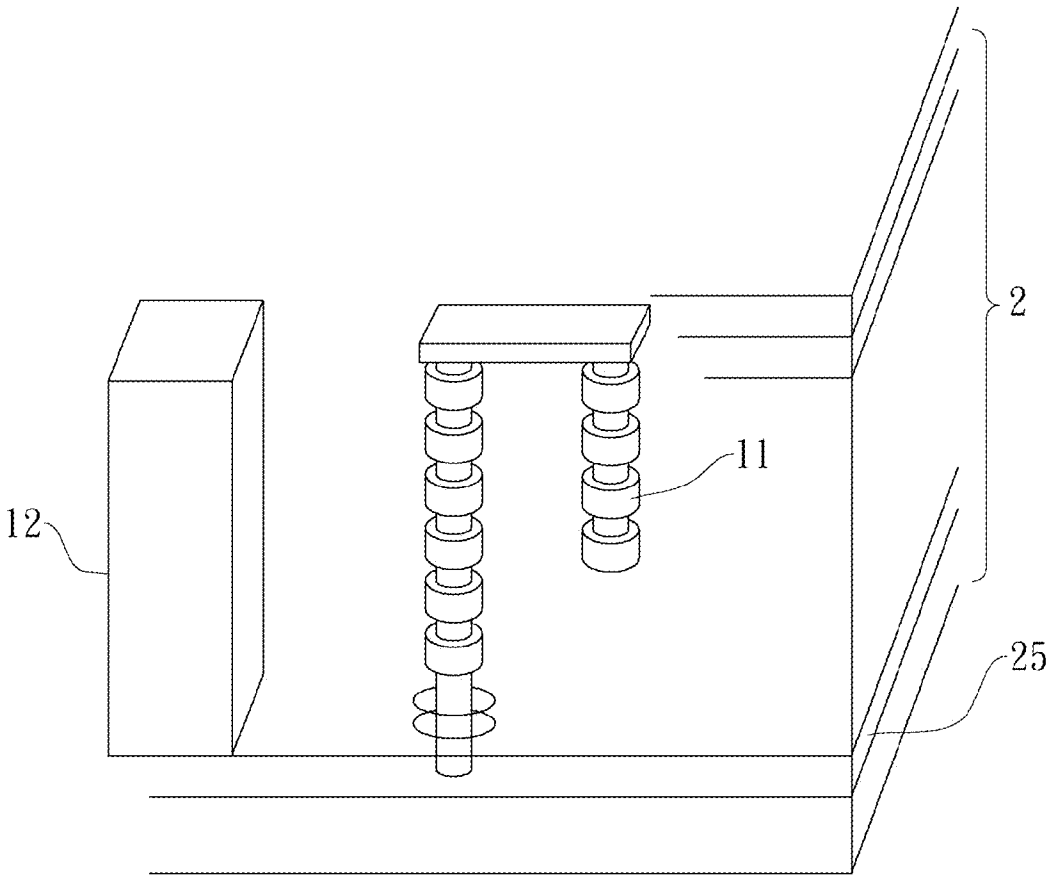
FIG. 3 shows a 3-D perspective view of the monopole antenna according to the first embodiment of the present invention.

FIG. 3 shows a 3-D perspective view of the antenna according to the first embodiment of the present invention. As shown in FIG. 3, the radiating body 11 is embedded in the substrates 2. To obtain a desired radiation direction of the antenna, a metal reflector 12 is preferably placed at an opposite direction of the antenna's desired radiation direction so as to concentrate its radiation in a desired direction. Also, a ground plane 25 is provided within the substrates 2.

Figure 4:
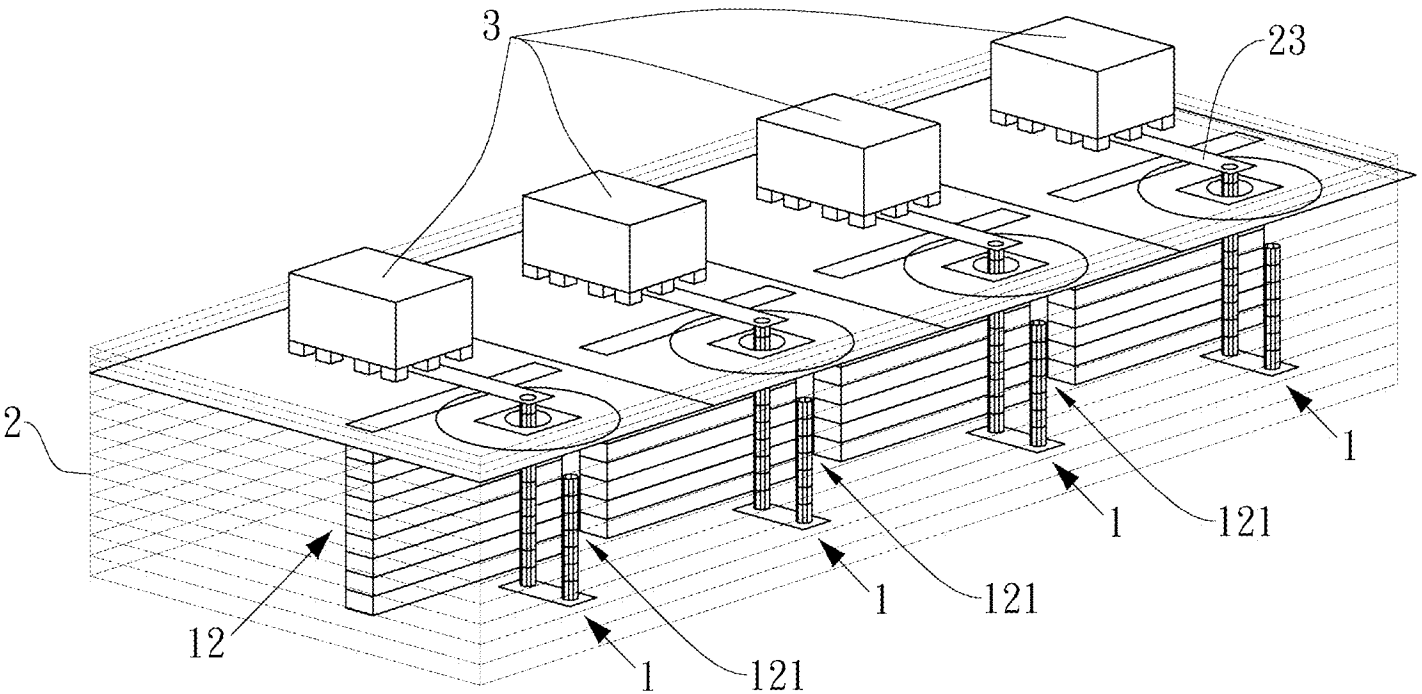
FIG. 4 is a schematic view showing an antenna array constitution of the monopole antennas according to the first embodiment of the present invention.

FIG. 4 is a schematic view showing an antenna array constituted by the monopole antennas of the first embodiment. When the antennas of the present invention are arranged side by side, they can form an antenna array with enhanced radiation and beam steering capabilities. To reduce interference caused by the mutual coupling between monopole antennas 1, as shown in FIG. 4, an isolation spacing 121 is preferably (but is not limited hereto) provided between the metal reflectors 12. One end of each feed line 23 is connected to a CMOS amplifier 3 for inputting and outputting electrical signals to each monopole antenna 1. The antenna array is embedded in the substrates 2. In this embodiment, the antenna array is constituted by monopole antennas but is not limited hereto; the antenna array of the present invention may be constituted by any other antennas embedded in substrates.

Figure 5:
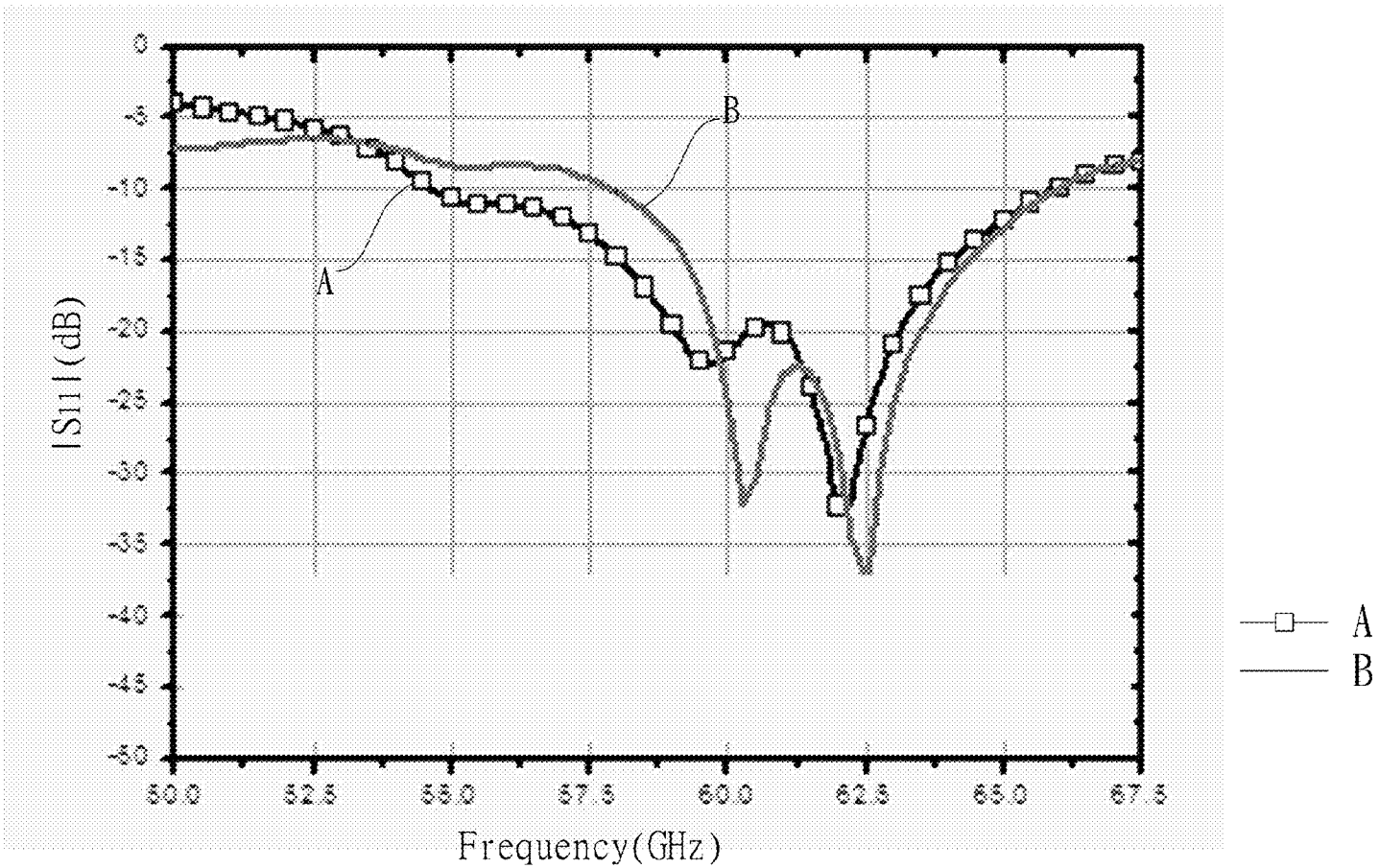
FIG. 5 shows a diagram illustrating return losses for the monopole antenna according to the first embodiment of the present invention.

FIG. 5 shows a diagram illustrating return losses for the antenna according to the first embodiment of the present invention. Curve A is the return loss curve for the monopole antenna of the present invention, where the antenna is composed of stacked vias. Curve B is the return loss curve for a conventional columnar monopole antenna realized by a single metal conductor cylinder of the same length. It is seen from this figure that for wireless communications operating in the 60 GHz millimeter-wave band, the monopole antenna of the present invention can have a satisfying operating bandwidth for application needs. Moreover, the present invention shows similar return loss characteristics as compared with a conventional columnar monopole antenna which is realized by a single metal cylinder.

Figure 6:
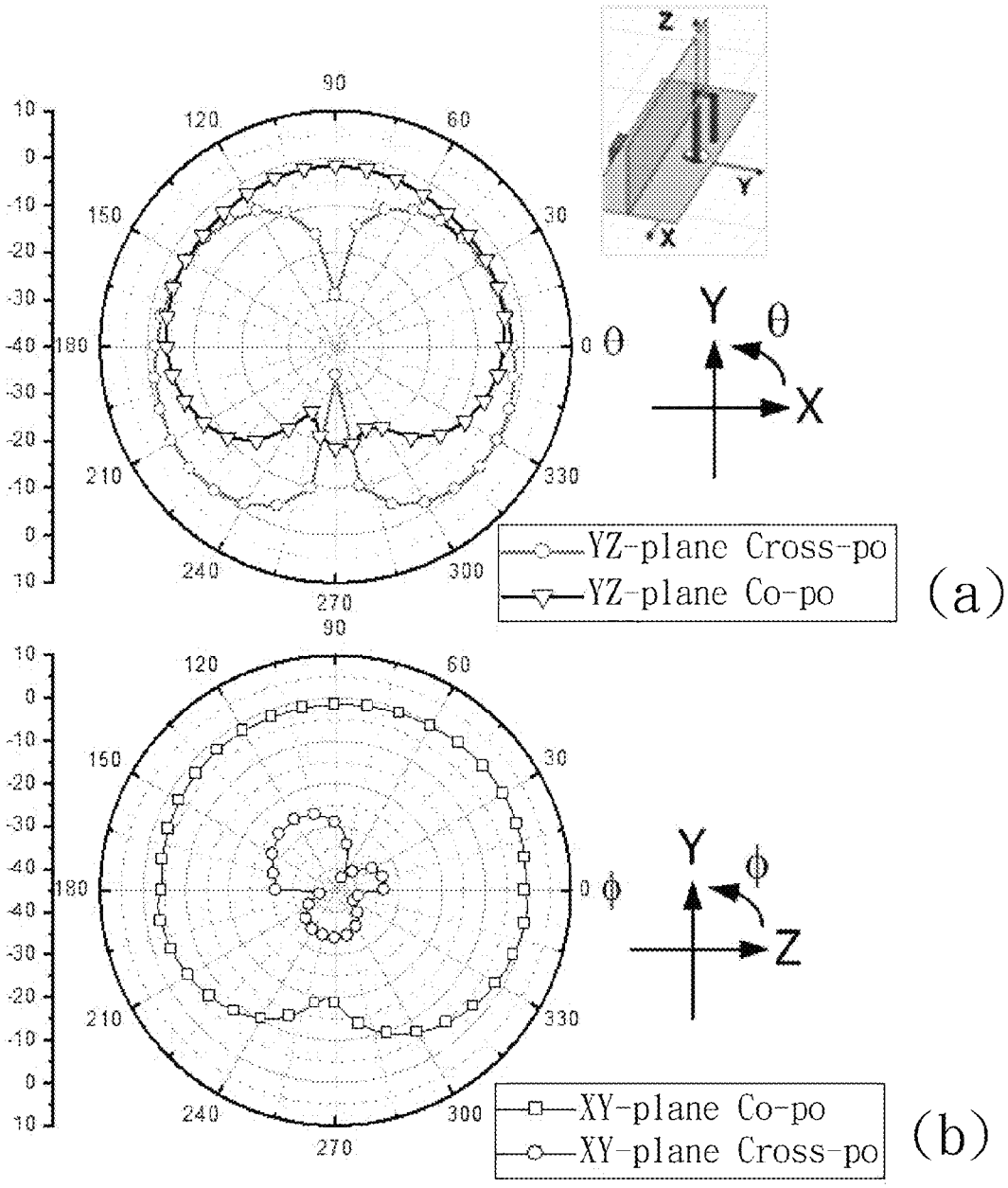
FIG. 6*a* is the radiation pattern on the YZ plane of the monopole antenna according to the first embodiment of the present invention.
FIG. 6*b* is the radiation pattern on the XY plane of the monopole antenna according to the first embodiment of the present invention.

FIGS. 6*a* and 6*b* show the radiation pattern of the antenna according to the first embodiment. It is seen from FIG. 6*a* that the antenna structure of this invention has a wide beam width in the co-polarization direction of the horizontal plane, and is therefore suitable for acting as a radiating unit of an antenna array. It is seen from FIG. 6*b* that the antenna has a wide beam width in the vertical direction (the XY-plane) and radiates in both upward and downward directions. Therefore, the antenna of the present invention can provide good end-fire radiation.

Second Embodiment

Figure 7A:
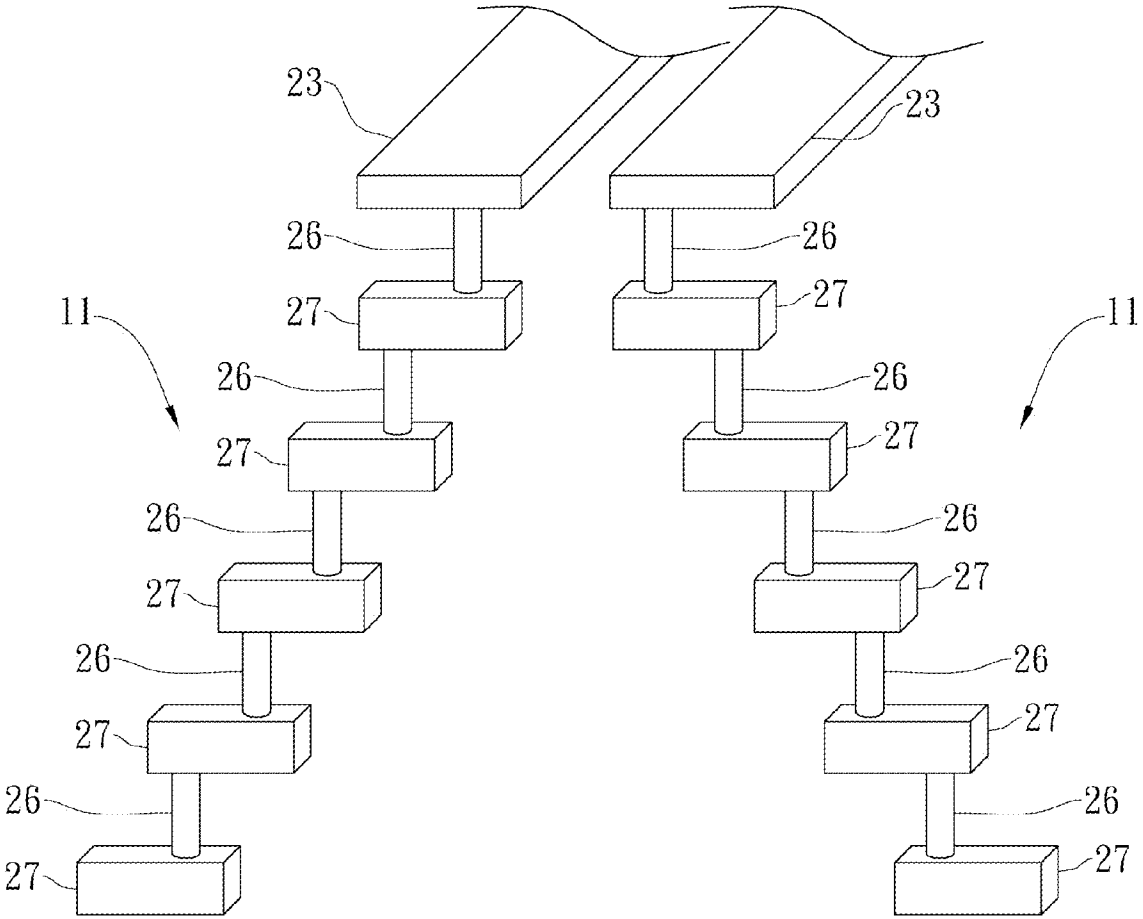
FIG. 7*a* is a schematic view showing a reverse V-shaped antenna according to a second embodiment of the present invention.
Figure 7B:
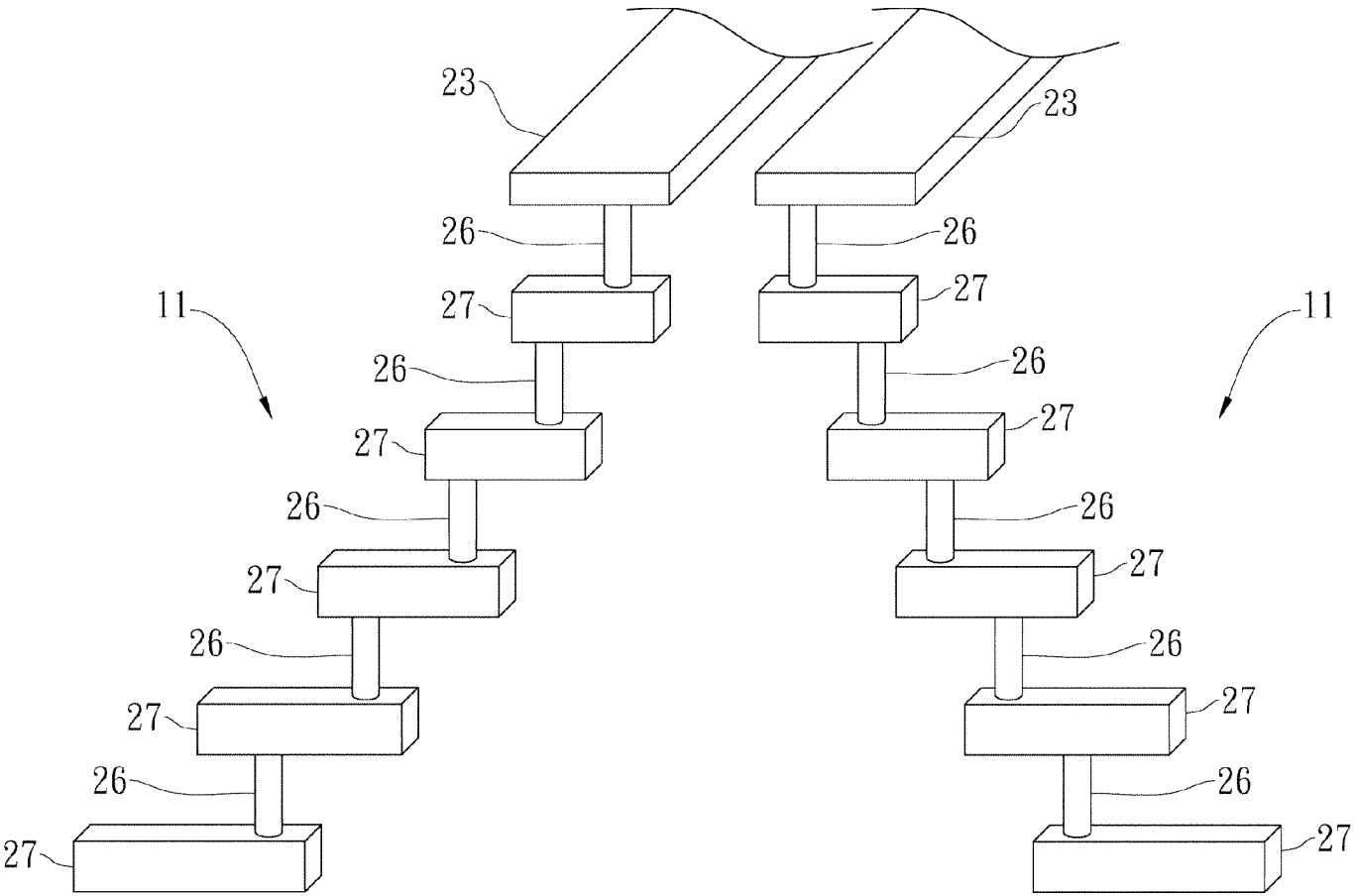
FIG. 7*b* is a schematic view showing another reverse V-shaped antenna according to the second embodiment of the present invention.

FIG. 7*a* is a schematic view showing a reverse V-shaped antenna according to a second embodiment of the present invention. As FIG. 7*a* shows, metal fills are filled into the through-holes to form metal vias 26. The location of metal via 26 and metal sheet 27 are offset at each layer to form a slanting columnar conductor in a reverse V-shape. This reverse V-shaped columnar conductor acts as a radiating body 11 of the antenna. The reverse V-shaped antenna comprises two feed lines 23. FIG. 7*b* shows that within the reverse V-shaped antenna, the embedded through-holes and the metal sheets 27 may have un-equal sizes. For example, the sizes of the embedded through-holes and the metal sheets 27 may increase along the downward direction.

Third Embodiment

Figure 8:
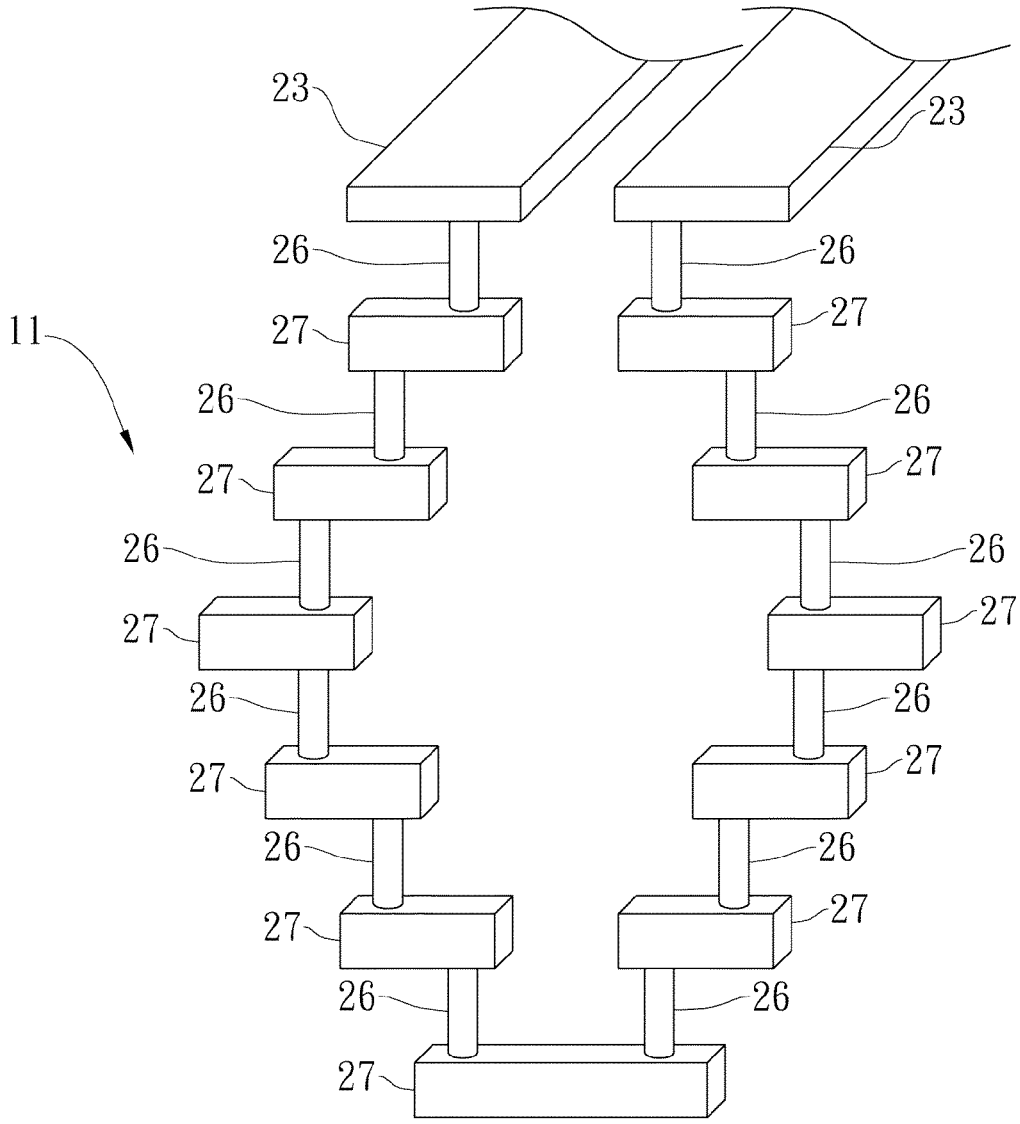
FIG. 8 is a schematic view showing an annular antenna according to a third embodiment of the present invention.

FIG. 8 is a schematic view showing an annular antenna according to a third embodiment of the present invention. As FIG. 8 shows, metal vias 26 and metal sheets 27 form an annular shape conductor, which acts as a radiating body 11 of the antenna. The annular antenna comprises two feed lines 23. Moreover, within the substrates of the annular antenna, the embedded through-holes and the metal sheets 27 may have un-equal sizes.

Fourth Embodiment

Figure 9A:
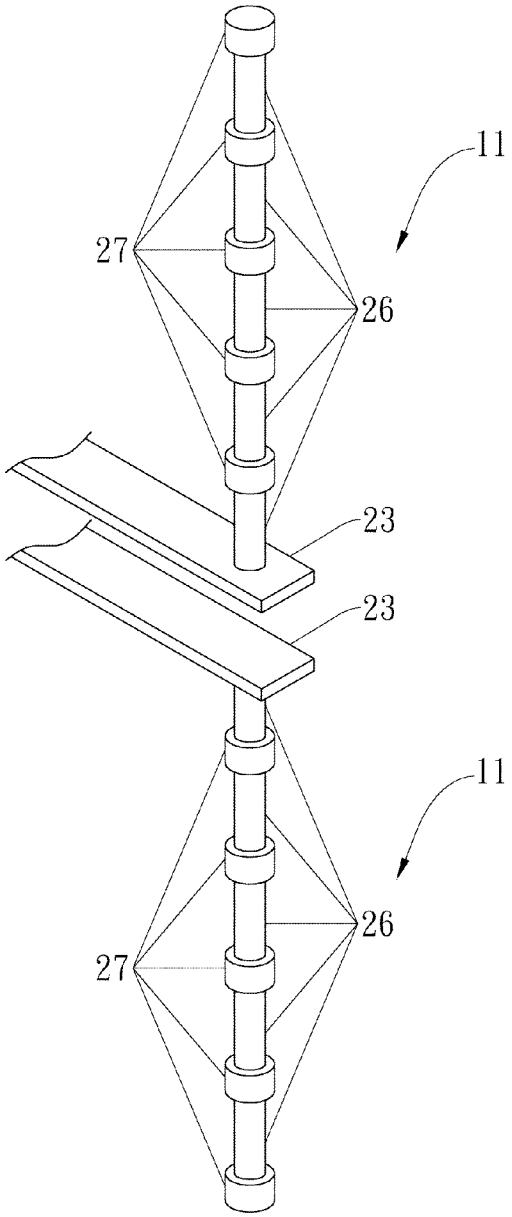
FIG. 9*a* is a schematic view showing a dipole antenna according to a fourth embodiment of the present invention.
Figure 9B:
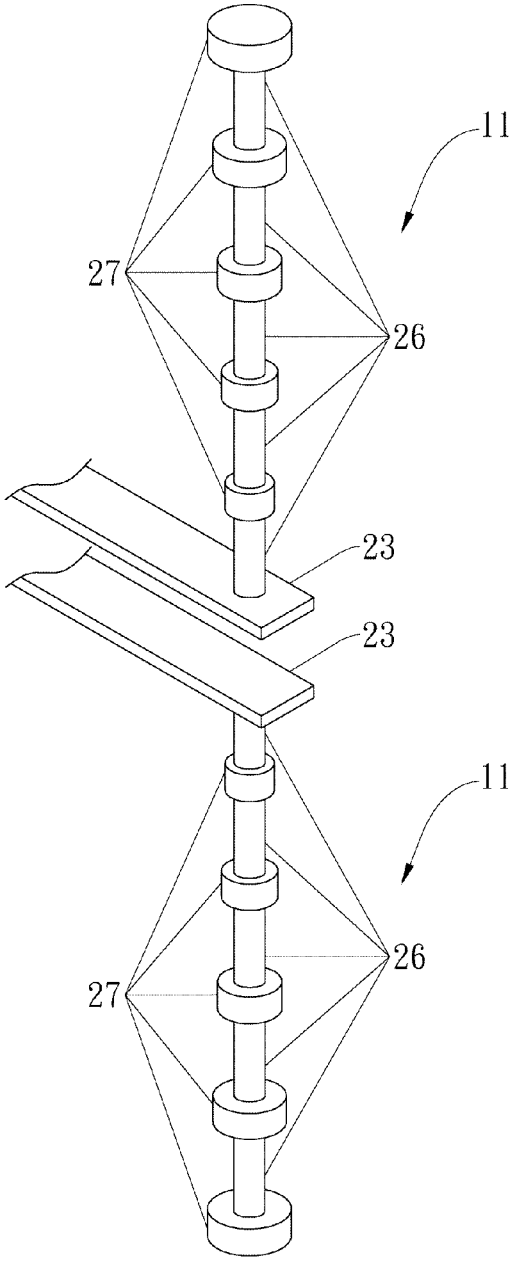
FIG. 9*b* is a schematic view showing another dipole antenna according to the fourth embodiment of the present invention.

FIG. 9*a* is a schematic view showing a dipole antenna according to a fourth embodiment of the present invention. As FIG. 9*a* shows, the through-holes and metal sheets 27 stacked to form two columnar metal conductors which are arranged symmetrically; the columnar metal conductors, together with two feed lines 23, form a dipole antenna. FIG. 9*b* shows that within the substrates of the dipole antenna, the embedded through-holes and the metal sheets 27 may have un-equal sizes. For example, the sizes of the metal sheets 27 may increase in both upward and downward directions, so that radiating body 11 appears bigger in both upward and downward directions.

The monopole antenna in the embodiments of the present invention is used for receiving and transmitting electromagnetic signals. It can be applied to smart phones or high-speed wireless data communication systems, and is particularly suitable for wireless HDMI (High-Definition Multimedia Interface) transmission. The monopole antenna in the preferred embodiments of the present invention radiates electromagnetic waves at a frequency of 60 GHz but the frequency is not limited hereto.

While this invention has been described by way of examples and in terms of preferred embodiments, it is to be understood that this invention is not limited hereto, and that various changes and modifications can be made by those skilled in the art without departing from the spirit and scope of this invention. It is intended that the scope of the invention be defined by the claims appended hereto.

What is claimed is:

1. An antenna, comprising:

a plurality of substrates, each of the substrates having at least one through-hole;

a metal fill placed within each of the plurality of through-holes, the metal fill within each through-hole connecting one another to form a columnar metal conductor which acts as a radiating body of the antenna;

a metal reflector placed at a direction opposite to a desired radiation direction of the radiating body to concentrate its radiation in a desired direction; and a feed line electrically coupled to the radiating body to input and output electrical signals.

2. The antenna according to claim 1, further comprising a ground plane within the plurality of substrates, each ground plane having a ground contact.

3. The antenna according to claim 1, wherein the metal fill is selected from silver or copper.

4. The antenna according to claim 1, wherein the plurality of substrates are made of or constituted by one of the following: fiberglass substrates, plastic, ceramic, low temperature co-fired ceramics (LTCC) and printed circuit boards (PCB).

5. The antenna according to claim 1, wherein the radiating body is a U-shaped folded monopole antenna.

6. The monopole antenna according to claim 5, wherein the length of the longer side of the monopole antenna is approximately ⅜ wavelength of the antenna's minimum operating frequency.

7. The monopole antenna according to claim 5, wherein the monopole antenna radiates electromagnetic waves at a frequency of 60 GHz.

8. The antenna according to claim 1, wherein the antenna has two feed lines and the radiating body is in a reverse V-shape.

9. The antenna according to claim 1, wherein the antenna has two feed lines and the radiating body has an annular shape.

10. The antenna according to claim 1, wherein the antenna is a dipole antenna.

11. An antenna array, constituted by a plurality of antennas according to claim 1 being arranged side by side.

12. The antenna array according to claim 11, wherein the metal reflector contains at least one isolation spacing.

* * * * *